US010711571B2

(12) United States Patent
Woodford

(10) Patent No.: US 10,711,571 B2
(45) Date of Patent: Jul. 14, 2020

(54) INJECTION DEVICE

(71) Applicant: TCO AS, Bergen (NO)

(72) Inventor: Keith Donald Woodford, Aberdeen (GB)

(73) Assignee: TCO AS, Bergen (NO)

( * ) Notice: Subject to any disclaimer, the term of this patent is extended or adjusted under 35 U.S.C. 154(b) by 462 days.

(21) Appl. No.: 15/506,409

(22) PCT Filed: Jun. 18, 2015

(86) PCT No.: PCT/GB2015/051780
§ 371 (c)(1),
(2) Date: Feb. 24, 2017

(87) PCT Pub. No.: WO2016/030657
PCT Pub. Date: Mar. 3, 2016

(65) Prior Publication Data

US 2017/0254177 A1 Sep. 7, 2017

(30) Foreign Application Priority Data

Aug. 28, 2014 (GB) ..... 1415277.1

(51) Int. Cl.
*E21B 21/10* (2006.01)
*E21B 34/10* (2006.01)
(Continued)

(52) U.S. Cl.
CPC ..... *E21B 34/10* (2013.01); *E21B 21/10* (2013.01); *E21B 34/08* (2013.01); *E21B 34/14* (2013.01); *E21B 2034/007* (2013.01)

(58) Field of Classification Search
CPC .... E21B 21/10; E21B 2034/007; E21B 34/08; E21B 34/085; E21B 34/108; E21B 34/101
See application file for complete search history.

(56) References Cited

U.S. PATENT DOCUMENTS 3,381,708 A * 5/1968 Chenoweth ..... E21B 34/08 137/504
3,794,063 A * 2/1974 Carroll ..... F16K 3/26 137/505.26

(Continued)

FOREIGN PATENT DOCUMENTS

WO 2013160686 10/2013
WO 2014037584 3/2014
WO 2014147032 9/2014

OTHER PUBLICATIONS

International Search Report of PCT Application No. PCT/GB2015/051780 dated Jan. 22, 2016: pp. 1-5.

*Primary Examiner* — Cathleen R Hutchins
(74) *Attorney, Agent, or Firm* — Chamberlain Hrdlicka

(57) ABSTRACT

An injection device comprises a housing comprising an inlet and an outlet and an outlet sleeve mounted within the housing and comprising at least one radial flow port therethrough for permitting fluid communication between the inlet and the outlet. A flow sleeve is mounted over the outlet sleeve and is arranged to move between a first position in which the at least one radial flow port is at least partially closed and a second position in which the at least one radial flow port is opened. The injection device also includes a flow sleeve actuator operable by a biasing arrangement and inlet pressure at the inlet of the housing to permit the flow sleeve to be selectively moved between its first and second positions to vary flow through the at least one radial flow port between the inlet and the outlet.

19 Claims, 9 Drawing Sheets

(51) Int. Cl.

| | |
|---|---|
| ***E21B 34/08*** | (2006.01) |
| ***E21B 34/14*** | (2006.01) |
| *E21B 34/00* | (2006.01) |

(56) References Cited

U.S. PATENT DOCUMENTS

| | | | | |
|---|---|---|---|---|
| 8,191,579 | B2 * | 6/2012 | Imhof | G05D 7/005 137/625.38 |
| 2010/0096127 | A1 | 4/2010 | Jordy | |
| 2014/0360725 | A1 * | 12/2014 | Xu | E21B 37/08 166/301 |

* cited by examiner

INJECTION DEVICE

FIELD OF THE PRESENT DISCLOSURE

The present disclosure relates to an injection device for injecting a fluid to a target location, such as a downhole location.

BACKGROUND TO THE PRESENT DISCLOSURE

Most wells, such as oil and/or gas wells, require fluid to be injected for a variety of requirements. These may include but are not limited to:

- Chemical Injection—where chemicals for the mitigation of phenomena such as scaling, wax build up, salt built up etc. are addressed by the injection of speciality chemicals which are formulated to address such issues. These applications tend to be performed at very low flow rates which are a very small fraction of the flow rates of the actual produced reservoir well fluids.
- Water De-Salting Injection—where water of either a pure or derived composition is injected to assist in the flushing away of salt deposits in the oil producing region in oil or gas formations. These applications are generally performed at moderate rates of flow which are a small fraction of the flow rates of the actual produced reservoir well fluids.
- Diluent Injection—where a fluid of a special composition is injected with the specific purpose of acting as a solvent to reduce viscosity and density of reservoir fluids in order to allow them to be more pumpable to improve or allow production to surface by methods such as a down hole mechanical pump, a down hole electric submersible pump (ESP), gas lift or other such methods of artificial lift. These applications tend to be performed at moderate to high flow rates which are a greater fraction of the flow rates of the actual produced reservoir well fluids.
- Direct Water injection—where water recovered from another well is injected in order to replenish reservoir pressures and volumes in order to assist in the production of other wells. This is generally performed at very high rates of flow comparable to the production flow rates that may occur form other producing wells.

Injection devices or valves are typically used to facilitate injection into a wellbore. Different types of injection device may be used depending on the nature of the injection, such as chemical type, flow rates etc. Some valves may operate to seek to provide a fixed pressure differential between inlet and outlet, for example by use of a power spring acting against a valve member. Further, some valves, such as disclosed in WO 2014/037584, the disclosure of which is incorporated herein by reference, seek to maintain an injection line in positive pressure, to avoid issues associated with negative or reduced pressures being present, for example caused by a U-tube effect, which might occur where injection fluids cascade through the injection line and injection valve to seek a hydrostatic equilibrium with the wellbore at the point of injection. This is particularly the case where operation of an injection valve is dependent on tracking the outlet pressure.

In some known valve designs, a flow path is selectively opened and closed by a valve member engaging and disengaging a valve seat. In some instances relative movement between the valve member and seat is caused by use of a sensor piston arrangement which moves in accordance with a differential between inlet pressure and a reference pressure. The sensor piston arrangement typically includes a sealing assembly exposed, in opposing directions, to the inlet and reference pressure s respectively, to permit pressure based control over the movement of the sensor piston. However, in many instances it is important for the sealing assembly of the sensor piston to define a larger, and in some cases a significantly larger diameter or area than the area of the valve seat. This firstly ensures that the pressure force applied over the area of the valve seat can be overcome by the sensor piston, and secondly assists to minimise hysteresis of operation as the valve member and valve seat are moved relative to each other from closed to opening and intermediate flow regulating positions.

However, in some instances, for example in downhole locations requiring very high injection flow rates, space is restricted to accommodate both large flow areas and a large ratio of areas between the sensor piston and the valve seat.

SUMMARY

An aspect of the present disclosure relates to an injection device, comprising:

a housing defining an inlet and an outlet;

an outlet sleeve mounted within the housing and defining at least one radial flow port therethrough for permitting fluid communication between the inlet and the outlet;

a flow sleeve mounted over the static outlet sleeve and arranged to move between a first position in which the at least one radial flow port is at least partially closed and a second position in which the at least one radial flow port is opened; and a flow sleeve actuator operable by a biasing arrangement and inlet pressure at the inlet of the housing to permit the flow sleeve to be selectively moved between its first and second positions to vary flow through the at least one radial flow port between the inlet and the outlet.

The outlet sleeve may be fixed within the housing. In such an arrangement the outlet sleeve may be defined as a static outlet sleeve.

The biasing arrangement may act to operate the flow sleeve actuator to permit the flow sleeve to move towards its first position in which the at least one radial flow port is at least partially closed. In some embodiments such an arrangement may permit the injection device to be deemed to be biased closed, or normally closed.

The flow sleeve actuator may be arranged such that action of inlet pressure may act to operate said actuator to permit the flow sleeve to move towards its second position.

The flow sleeve actuator may selectively move or permit movement of the flow sleeve in accordance with the biasing arrangement and inlet pressure to positions intermediate the first and second positions to provide infinite variations in flow through the at least one radial flow port.

In use, the flow sleeve may be initially held in its first position by action of the biasing arrangement, with fluid pressure then increased at the inlet until the generated force applied by this inlet pressure exceeds the biasing force applied on the flow sleeve actuator by the biasing arrangement. At this point the flow sleeve may be permitted to be moved towards its second position, increasing the flow area through the at least one radial flow port. During this initial or increased flow through the at least one radial flow port, inlet pressure will reduce, causing automatic adjustment of the flow sleeve actuator and thus the flow sleeve, to restrict or choke flow. Such choked flow will result in a back pressure being applied at the inlet, thus again increasing inlet pressure, with the flow sleeve actuator being automatically adjusted. Such adjustment will continuously and autonomously be made, effectively achieving a forward flow equilibrium position with the inlet pressure being maintained at a fixed and absolute pressure. The equilibrium inlet pressure may thus be a function of the biasing arrangement, and be largely or entirely independent of outlet pressure. Such an arrangement may provide significant advantages in addressing issues with u-tubing or hydrostatic fall-through in injection lines associated with the injection device.

In some embodiments or applications such an equilibrium position may be achieved in a very short time period, with almost immediate and slight movements of the flow sleeve retaining equilibrium.

The radial nature of the at least one flow port in the outlet sleeve is such that any pressure presented to the flow port will act in a radial direction or in such a way that the pressures exposed to the device outlet will not produce forces tending to act linearly (axially) on any body or component that is part of the pressure controlling function of the device. Such an arrangement may assist to avoid any adverse opposing forces to the opening force achieved by inlet fluid pressure acting on the flow sleeve actuator. This may permit miniaturisation of the device, without necessarily overly compromising on flow area due to reduced possibilities for hysteresis of operation due to adverse forces opposing opening of the device.

The flow sleeve may be arranged to move axially relative to the outlet sleeve. In such an arrangement, the flow sleeve actuator may be arranged to permit or control axial movement of the flow sleeve. In some embodiments, however, the flow sleeve may be rotatable relative to the outlet sleeve.

The outlet sleeve may comprise a wall structure, for example a cylindrical wall structure. The at least one radial flow port may be provided in the wall structure. One end of the wall structure may be fixed relative to the housing. One end of the wall structure may be sealingly fixed relative to the housing. Such sealing may isolate or prevent any by-pass of fluid between the inlet and the outlet.

The outlet sleeve may define a can form, wherein the wall structure is closed by a base at one end. In such an arrangement all flow may be restricted to the at least one radial flow port, such that the advantages of the radial flow in terms of avoiding adverse axial pressure forces acting in the device may be maximised.

The outlet sleeve may define a plurality of radial flow ports. Such flow ports may be circumferentially distributed, for example evenly circumferentially distributed around the outlet sleeve.

The flow sleeve may be mounted on the upstream side of the outlet sleeve (i.e., on the inlet side). This may assist to isolate the flow sleeve from the effect of outlet pressure.

The flow sleeve may be sized to fit over the outer surface of the outlet sleeve, such that movement of the flow sleeve may function to vary the flow area through the at least one radial flow port.

In some embodiments the outlet sleeve and the flow sleeve may be arranged to interact such that a preferential rate of variation in flow area between the inlet and the outlet is achieved during movement of the flow sleeve relative to the outlet sleeve. In one embodiment a linear rate of variation in flow area may be achieved during a constant rate of movement of the flow sleeve. In other embodiments a non-linear rate of variation in flow area may be achieved. Such a non-linear rate of variation may be achieved by appropriate shaping or profiling of the at least one radial flow port, and/or of the flow sleeve.

In one embodiment at least one radial flow port may be defined by a circular port or orifice. In some embodiments at least one radial flow port may be defined by an elongate slot. Such an elongate slot may be elongate in an axial direction relative to the outlet sleeve. In some cases an elongate slot may be elongate in a circumferential, and/or spiral direction.

The flow sleeve may comprise a wall structure arranged to be received over the outlet sleeve. In such an arrangement the flow sleeve may define a larger diameter than the outlet sleeve. This may permit a general telescopic motion to be established between the outlet and flow sleeves during movement of the flow sleeve. In one embodiment when the flow sleeve is in its first position the wall structure may at least partially block or occlude the at least one flow port in the outlet sleeve, thus preventing or restricting flow through the device. Further, when the flow sleeve is in its second position the wall structure may be retracted or moved to open or further open the at least one flow port in the outlet sleeve, thus increasing flow through the device.

The flow sleeve may be moved such that an end region of the wall structure may be moved over the at least one radial flow port of the outlet sleeve to vary the flow area. In this respect the flow area may be infinitely adjusted depending on the position of the flow sleeve and extent to which the at least one flow port in the outlet sleeve is opened or occluded.

A close fitting tolerance may be achieved between the flow sleeve and the outlet sleeve. Such a close fit may provide a degree of fluid sealing/restriction when the flow sleeve in its first position. In some instances a degree of leakage of fluid from the housing inlet and the outlet may be tolerated when the flow sleeve is in its first position.

In some embodiments a sealing arrangement may be provided between the flow sleeve and the outlet sleeve.

The at least one radial flow port of the outlet sleeve may define at least one first radial flow port, and the flow sleeve may define at least one second radial flow port. In use, the first and second radial flow ports may facilitate flow through the device from inlet to outlet. Said at least one second radial flow port may be formed in a wall structure of the flow sleeve. In use, when the flow sleeve is in its first position the at least one first flow port and the at least one second flow port may be substantially misaligned, such that flow through the device is prevented or restricted. When the flow sleeve is in its second position the first and second flow ports may be substantially aligned to permit flow through the device. Intermediate positioning of the flow sleeve may provide a variation in flow.

Because a radial flow path is achieved by the first and second radial flow ports any pressures that occur in the region of the flow ports will act largely radially, and not axially. Thus, any pressures that occur as fluid is passed through the flow ports of the flow sleeve and the outlet sleeve as well as any pressures acting on the device outlet shall not create forces that will act on, or resit, the flow sleeve actuator, which will thus be permitted to be operated largely on the basis of inlet pressure and the biasing arrangement. This arrangement can permit the device to allow a greatly variable flow performance at a uniform inlet pressure and tolerate wide variations in the outlet pressure presented to the device outlet.

From this, embodiments of the present disclosure may allow for a very large controllable flow area to be presented to allow communication of flow form the inlet to the outlet without this presented flow area having any direct influence on the effective area of the flow sleeve actuator. This may assist to address a limitation of the prior art in that there is no need to increase the effective area of the flow sleeve actuator to a significant value above that of the flow area that is provided by the device. This therefore means a very compact device may be provided which will provide a wide variation of flow rates with capability of extremely high flow without having to employ a large flow sleeve actuator and therefore large housing for said actuator. This present disclosure therefore allows for a reduced housing size in applications with space restrictions, such as in a downhole environment.

The flow sleeve may comprise a plurality of second radial flow ports. The plurality of second radial flow ports may be arranged circumferentially, for example evenly circumferentially around the flow sleeve.

One or all of the at least one first and second flow ports may define profiles to establish a desired rate of flow variation during movement of the flow sleeve.

The housing may define an inlet chamber for receiving fluid through the inlet. At least a portion of the outlet sleeve may extend into the inlet chamber, and provide fluid communication, via the at least one radial flow port, between the inlet chamber and the outlet of the housing. The flow sleeve may operate within the inlet chamber.

The flow sleeve actuator may be in pressure communication with the inlet chamber such that inlet pressure may act to operate the flow sleeve actuator.

The housing may be provided as a single component. Alternatively, the housing may be provided in multiple components which are intended to be coupled and/or operated together.

The injection device may comprise one or more non-return or check valves associated with the outlet of the housing, for example in fluid communication with the fluid outlet of the housing. The non-return or check valve may function to prevent or minimise reverse flow through the device from outlet to inlet. In some embodiments the check valve may be provided in accordance with that disclosed in applicant's co-pending application number PCT/EP2014/055319, the disclosure of which is incorporated herein by reference.

The non-return or check valve may be at least partially accommodated within the housing. In some embodiments the housing may define an outlet chamber, wherein the non-return or check valve may be at least partially located within the outlet chamber.

In some embodiments the non-return or check valve may be provided in a separate housing, connected via a conduit, for example.

The injection device may comprise a venting arrangement provided between the outlet sleeve and the flow sleeve. Such a venting arrangement may minimise the risk of hydraulic locking between said sleeves during relative movement therebetween.

The injection device may comprise an engagement mechanism for providing engagement between the flow sleeve actuator and the flow sleeve.

The engagement mechanism may comprise or define a rigid connection between a portion of the flow sleeve actuator and the flow sleeve. In such an arrangement movement of the flow sleeve actuator may result in corresponding movement of the flow sleeve. In some embodiments the engagement mechanism may comprise a rod extending between the flow sleeve and the flow sleeve actuator.

The engagement mechanism may define or permit a degree of relative movement between the flow sleeve actuator, or at least a portion thereof, and the flow sleeve. In some embodiments the flow sleeve may define a floating sleeve, wherein the engagement mechanism provides selective coupling or engagement between the flow sleeve and the flow sleeve actuator. In some instances the engagement mechanism may provide a degree of lost motion between the flow sleeve actuator and the flow sleeve.

The engagement mechanism may comprise a pick-up arrangement configured to initially permit relative movement between the flow sleeve actuator and the flow sleeve, followed by collective movement.

The flow sleeve actuator may comprise an inlet pressure interface in pressure communication with the inlet of the housing, such that, in use, inlet pressure may act on said pressure interface to effect movement of the flow sleeve actuator, and thus of the flow sleeve.

The biasing arrangement may comprise a spring arrangement. The spring arrangement may act directly against the flow sleeve. Alternatively, the spring arrangement may act indirectly on the flow sleeve, for example via an intermediate member forming part of the flow sleeve actuator.

The biasing arrangement may comprise a fluid pressure biasing arrangement. In one embodiment the biasing arrangement may comprise a resistance pressure biasing arrangement. In such an arrangement the resistance pressure may resist movement of the flow sleeve actuator (by action of inlet pressure), thus establishing a biasing force on said actuator.

The resistance pressure may be provided by a pressurised liquid. The resistance pressure may be provided by pressurised or compressed gas. The gas may comprise, for example, nitrogen.

The injection device may comprise or define a pressure chamber in pressure communication with the flow sleeve actuator, wherein the pressure chamber contains or is configured to receive, in use, a resistance pressure for use in providing a biasing force on the flow sleeve actuator. Such a pressure chamber may be provided within the housing of the device. Alternatively, the pressure chamber may be provided in a separate housing and communicated to the flow sleeve actuator, for example via a conduit, pressure transfer device or the like.

The pressure chamber may define a closed chamber. In such an arrangement the closed pressure chamber may be charged with a pressurised fluid to a desired pressure.

The pressure chamber may define a pressure inlet, for receiving pressurised fluid from an external source.

The flow sleeve actuator may comprise a pressure interface arrangement in opposing pressure communication with the housing inlet and the pressure chamber, such that, in use, the pressure interface arrangement may be moved by the effect of both inlet pressure and pressure. The pressure interface arrangement may be operably connected, for example via an engagement arrangement, to the flow sleeve.

The pressure interface arrangement may comprise an interface member in pressure communication with both the housing inlet and the pressure chamber. A single interface member may be provided, such that one side of the interface member is in pressure communication with the housing inlet, and an opposite side of the interface member is in pressure communication with the pressure chamber.

The interface member may be sealed relative to the housing. The interface member may be sealed relative to the housing via a seal member, such as an O-ring or the like. The interface member may be sealed relative to the housing via a flexible seal arrangement, such as a bellows seal arrangement.

The interface member may comprise a piston member.

The pressure interface arrangement may comprise first and second interface members, wherein the first interface member is in pressure communication with the housing inlet, and the second interface member is in pressure communication with the pressure chamber. An intermediate chamber may be defined between the first and second interface members. The intermediate chamber may define a transfer chamber, configured to transfer the effect of pressure acting on the respective first and second interface members. The intermediate chamber may comprise a pressure transfer medium. The pressure transfer medium may comprise a fluid, gel, elastic material or the like. In some embodiments the pressure transfer medium may comprise silicon oil.

The intermediate chamber may be sealingly isolated from both the housing inlet and the pressure chamber, for example by one or more sealing arrangements, such as an O-ring, bellows arrangement, flexible, for example elastic, membrane or the like.

At least one of the first and second interface members may comprise a piston member.

At least one of the first and second interface members may comprise a bellows arrangement.

At least one of the first and second interface members may comprise an inflatable structure, such as an inflatable elastic structure or the like. Such an inflatable structure may be mounted on a tubular member. The tubular member may define one or more ports to facilitate fluid transfer between an internal volume of the tubular member and the inflatable structure. The tubular member may be sintered. In some embodiments the inflatable structure may be associated with the pressure chamber. In such a case, inflation of the inflatable structure within the pressure chamber functions to increase pressure therein, and vice versa.

Fluid passing through the ports in the tubular member may provide a dampening effect. This may be used to reduce potential oscillations should there be any risk of drastically changing pressures on the outlet which may cause fluctuations in axial movement of the flow sleeve.

The pressure interface arrangement may comprise a movement limiter for limiting permitted movement of the or at least one interface member. Such an arrangement may assist to prevent over-pressure within the pressure interface arrangement, which may otherwise cause damage to seals and the like. This may have particular application where a charge pressure is initially provided in the pressure chamber, with ambient pressure provided at the housing inlet. In such instances the potentially very large pressure differential may damage the interface arrangement, possibly eliminating the effect of the pressure chamber, and thus significantly affecting operation of the injection device.

In some embodiments at least one interface member may sealingly engage a movement limited upon engagement therewith. Such an arrangement may provide additional sealing contingency within the system.

In one embodiment the first and second interface members may be similar in form. For example, both interface members may comprise a piston member, bellows arrangement, inflatable member or the like.

Alternatively, the first and second interface members may be different in form.

The injection device may define a downhole injection device, for example for use in facilitating injection into a wellbore. The injection device may form part of a completion system. The injection device may be retrievable. The injection device may be for use within a side-pocket mandrel within a completion system.

The injection device may be for use in facilitating injection of any desired fluid to a target location. In some embodiments the injection device may be for use in diluent injection into a well bore completion, for example to assist with production of fluids to surface via the completion.

In embodiments where the flow sleeve is a floating sleeve, a further biasing arrangement may be provided, to bias the flow sleeve in a desired direction, for example towards its first position. In such an arrangement any eventual pick-up of the flow sleeve by the engagement mechanism may cause the flow sleeve to be moved against this further bias.

An aspect of the present disclosure relates to a method for injecting a fluid from a source to a target location, comprising:

coupling a fluid source to an inlet of an injection device;

coupling an outlet of the injection device to a target region;

using inlet pressure in combination with a biasing force to control movement of a flow sleeve actuator of the injection device to control relative movement between an outlet sleeve and a flow sleeve contained within the injection device, wherein said relative movement varies exposure of a radial port in the outlet sleeve to the inlet.

The method may comprise use of the injection device according to any other aspect.

An aspect of the present disclosure relates to an injection system comprising an injection device according to any other aspect. The injection system may comprise an injection line coupled the injection device. The injection system may form part of a completion system.

An aspect of the present disclosure relates to a well bore completion system comprising a wellbore flow path, and an injection device according to any other aspect for use in facilitating injection of a fluid into said wellbore flow path. The wellbore completion system may comprise artificial lift equipment, such as an ESP.

An aspect of the present disclosure relates to an actuator, comprising:

an actuatable member;

an actuator arrangement operatively associated with the actuatable member for use in controlling movement of said actuatable member, wherein the actuator arrangement comprises a pressure interface arrangement in pressure communication with first and second sources of pressure.

In use, the first and second pressure source may function to operate or control movement of the actuator arrangement and thus the actuatable member.

The actuatable member may comprise a flow sleeve.

The actuator arrangement may comprise a pressure interface arrangement as defined in relation to any other aspect.

An aspect of the present disclosure relates to a method for actuating an actuatable member comprising:

coupling the actuatable member to an actuator arrangement having a pressure interface arrangement; and exposing the pressure interface arrangement to first and second sources of pressure to cause movement of the actuator arrangement and actuatable member.

Features defined in relation to one aspect may be used in combination with any other aspect.

BRIEF DESCRIPTION OF THE DRAWINGS

These and other aspects of the present disclosure will now be described, by way of example only, with reference to the accompanying drawings, in which:

FIG. 6 provides a representative example of a flow curve associated with an injection valve subject to hydrostatic fall-through;

DETAILED DESCRIPTION OF THE DRAWING

Aspects of the present disclosure relate to an injection device, which may be embodied for use in a wellbore, such as associated with oil and gas exploration and production. Exemplary embodiments of injection device according to the present disclosure will be described later. However, the immediate discussion below presents details of problems recognised by diligent investigations by the present inventor.

Figure 1:
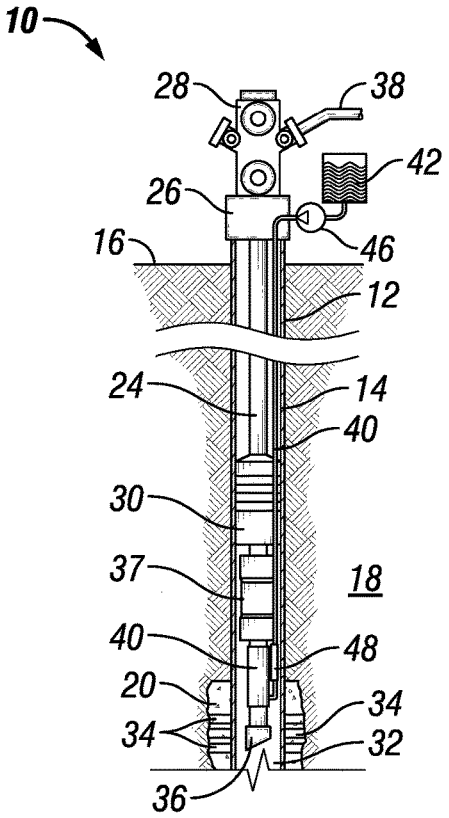
FIG. 1 is a diagrammatic illustration of a wellbore completion installation with injection capabilities.

A wellbore completion installation with injection capabilities is diagrammatically illustrated in FIG. 1. The wellbore, generally identified by reference numeral 10, comprises a casing string 12 located within a drilled bore 14 which extends from surface 16 to intercept a hydrocarbon bearing formation or reservoir 18. A lower annulus area 20 defined between the casing 12 and bore 14 may be filled with cement 22. A production tubing string 24 extends into the casing 12 from a wellhead 26 and production tree 28. The production tree 28 may provide the necessary pressure barriers and provides a production outlet 38 from which produced hydrocarbons may be delivered to a production facility (not shown), for example.

A lower end of the production tubing string 24 is sealed against the casing 12 with a production packer 30 to isolate a producing zone 32. A number of perforations 34 are established through the casing 12 and cement 22 to establish fluid communication between the casing 12 and the formation 18. Hydrocarbons may then be permitted to flow into the casing 12 at the producing zone 32 and then into the production tubing 24 via inlet 36 to be produced to surface.

In some installations the reservoir 18 may have sufficient pressure to allow delivery of reservoir fluids to surface without any assistance. In such well completions the reservoir pressure must be sufficient to overcome the hydrostatic fluid pressure in the production tubing 24 as vertical height progresses to surface.

However, some well completions may not have sufficient reservoir pressure to produce flow to the surface and will require assistance in order to allow this production flow to occur. For such cases the well may be completed to include methods of artificial lift. This may be by way of gas which is injected into the producing reservoir zone to lessen the density of the oil or condensate which then reduces the hydrostatic resistance allowing well fluids to produce to surface.

Artificial lift equipment, such as an electric submersible pump (ESP) 37 may optionally be installed in-line with the production tubing 24 as part of the completion to assist production to surface. Such an ESP 37 may be used where reservoir fluids are of a high viscosity and/or density. Another purpose of the ESP 37 may be to deliberately deplete reservoir pressure. This may have the effect of causing entrained gas within heavy oil to "gas-out" thus inherently lessening the viscosity and density of the reservoir fluid allowing it to produce either itself or with less assistance. Also, this approach may be used to enhance the recovery of residual oil within mature reservoirs which would otherwise be too heavy to flow and produce.

An injection line or conduit 40 runs alongside the production tubing 24 from a surface located injection fluid source 42 to a downhole target location, which in the illustrated example is a lower end of the production tubing 24, below the ESP 37. The injection line 40 may be clamped to the production tubing 24, and may be deployed inside the casing 12 along with the production tubing 24 at the time of completion. The production tubing 24 may include an optional injection mandrel 44. An injection pump 46 is located at a topside location to facilitate injection of the injection fluid 42.

An injection valve 48 is located in a lower region of the injection line 40 and functions to permit fluid injection into the production tubing 24 while preventing reverse flow back into the injection line 40. Although the injection valve 48 is shown externally of the mandrel, in some embodiments an injection device or valve according to the present disclosure may be mounted in a side-pocket of the mandrel. This may facilitate wireline recovery/replacement of such a valve.

Some drawbacks of existing injection valves have been identified through diligent investigations by the present inventor and are set out below with reference to FIGS. 2 to 8. Following a discussion of these drawbacks, some exemplary embodiments of the present disclosure will be set out.

Figure 2:
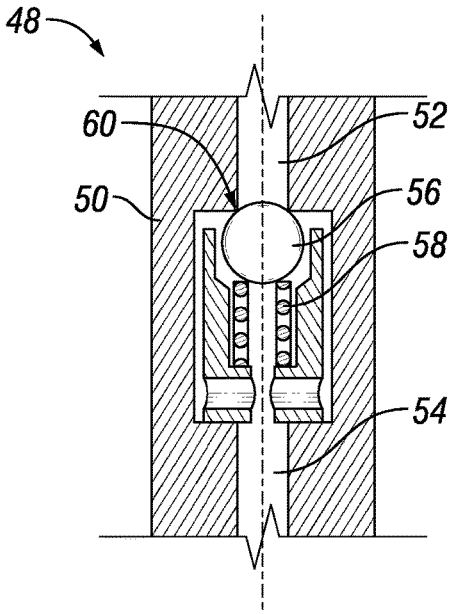
FIG. 2 (Prior Art)
FIG. 2 is a diagrammatic illustration of a known injection or check valve.
Figure 3:
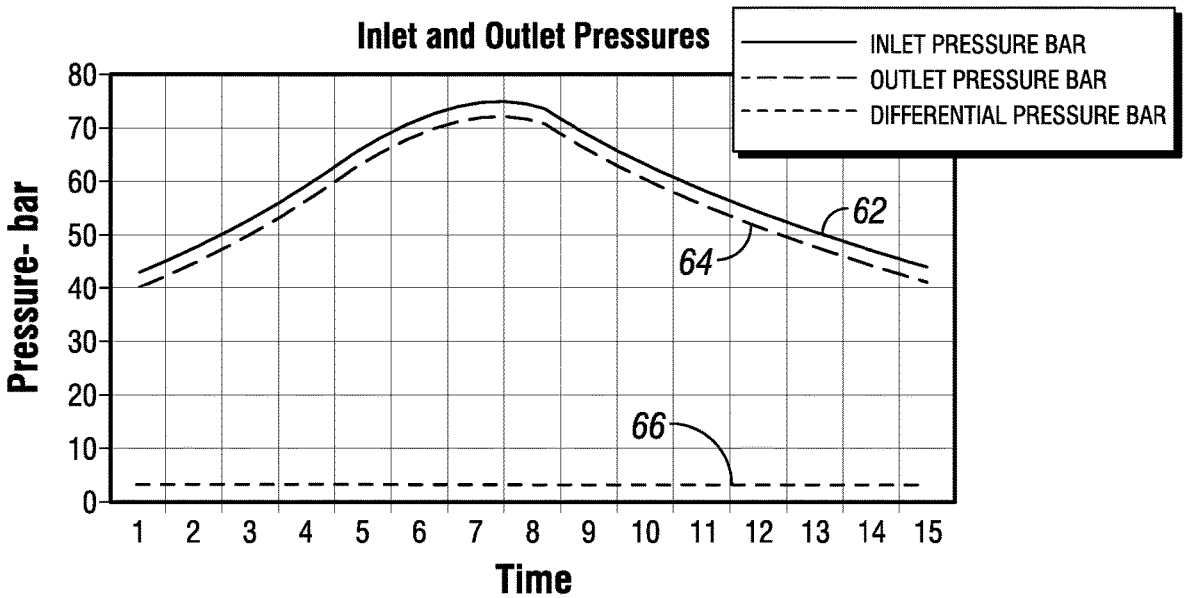
FIG. 3 provides a representative example of pressure curves associated with the valve of FIG. 2.

Referring initially to FIG. 2, a diagrammatic cross-sectional illustration of a known check valve, still referred to by reference numeral 48, is provided. In this example the check valve 48 includes a housing 50 with an inlet 52 for communicating with the injection line 40 and an outlet 54 for communicating with the production tubing 24. A ball 56 (other similar members such as pistons and poppets are also known) is mounted in the housing 50 and is biased by a spring 58 towards a closed position in which the ball 56 sealingly engages a seat 60 to prevent flow through the housing 50. To permit injection the fluid pressure at the inlet 52 must establish a downward force on the ball 56 which exceeds the combined force of the spring 58 and the pressure at the outlet 54, which act in the opposing direction. Accordingly, in normal flow conditions the inlet pressure will be a fixed differential above the outlet pressure by a magnitude dictated primarily by the force of the spring 58. An exemplary graphical representation of the effects of varying the inlet or outlet pressures is provided in FIG. 3. As shown, irrespective of pressure fluctuations at the outlet 54, the inlet pressure 62 will always be a fixed value above the outlet pressure 64 by a differential 66 which is defined primarily by the spring 58.

In injection there is always a hydrostatic pressure gradient present in the injection line 40. This pressure gradient is a function of the density of the fluid and the true vertical height of the well known as the TVD (True Vertical Depth).

As depth increases, the hydrostatic pressure will linearly increase, such that the maximum hydrostatic pressure will act at the inlet 52 of the injection valve 49. This hydrostatic pressure will act in a direction to open the ball 56 of the valve 48 against the combined resistance of the spring 58 and the pressure at the valve outlet 54, which will be largely equal to the pressure within the production tubing 24 at the point of injection. There may be circumstances where the hydrostatic pressure force acting at the valve inlet 52 exceeds the resistance provided by the valve outlet pressure and the spring 58, for example where large hydrostatic pressures exist in deeper wells, and/or where relatively low wellbore pressures exist, for example due to operation of the ESP 37. In such circumstances the result can be the undesirable flow or cascading of injection fluid into the target location. This effect may be termed "hydrostatic fall-through".

If unchecked such hydrostatic fall-through will occur until the hydrostatic pressure within the injection line 40 is in equilibrium with the target location pressure and the resistance provided by the valve spring 58. If the injection fluid is not continuously replenished, or not replenished as quickly as the injection fluid cascades through the valve 48, then the result will be the creation of low, vacuum or near vacuum pressures in the upper region of the injection line 40. Such a vacuum may present the injection line 40 to adverse mechanical forces and stresses, such as radial collapse forces. Furthermore, the established vacuum may be defined by a pressure which is lower than the vapour pressure of the injection fluid, thus causing the injection fluid to boil. This may be compounded by the effect of the increased temperatures associated with wellbore environments. The consequence of vacuum occurrence in chemical injection lines is that the original fluid may not be able to retain its intended state and the fluid carrier will boil off. This has the potential of many adverse effects, such as solid depositing, viscosity change, crystal formation, waxing, partial or full solidification, and generally changes within the fluid causing loss of effectiveness of the injection chemical, and the like.

To provide a numerical example, for an injection line which has a TVD of 1420 meters with an injection fluid having a density of 1050 kg/m$^3$, the hydrostatic pressure (calculated by the product of fluid density, gravity and TVD) acting at the inlet 52 of the valve 48 will be in the region of 146 bar. If the pressure in the production tubing 24 at the point of injection is 95 bar, and assuming that the valve spring 58 and other flow resistance is equivalent to providing 2 bar of pressure resistance, then this creates a pressure differential across the valve of 49 bar. Accordingly, due to the tendency for the system to seek equilibrium the injection fluid within the injection line 40 will cascade through the valve 48 until the height of injection fluid establishes a hydrostatic pressure at the valve inlet 52 which is in equilibrium with the pressure in the production tubing plus other resistance, which in the present example will be 97 bar. Thus, a hydrostatic pressure of 97 bar at the valve inlet 52 will require the injection fluid to cascade to define a height of around 942 metres. This will therefore leave the upper 478 meters of the injection line 40 under vacuum conditions.

Figure 4:
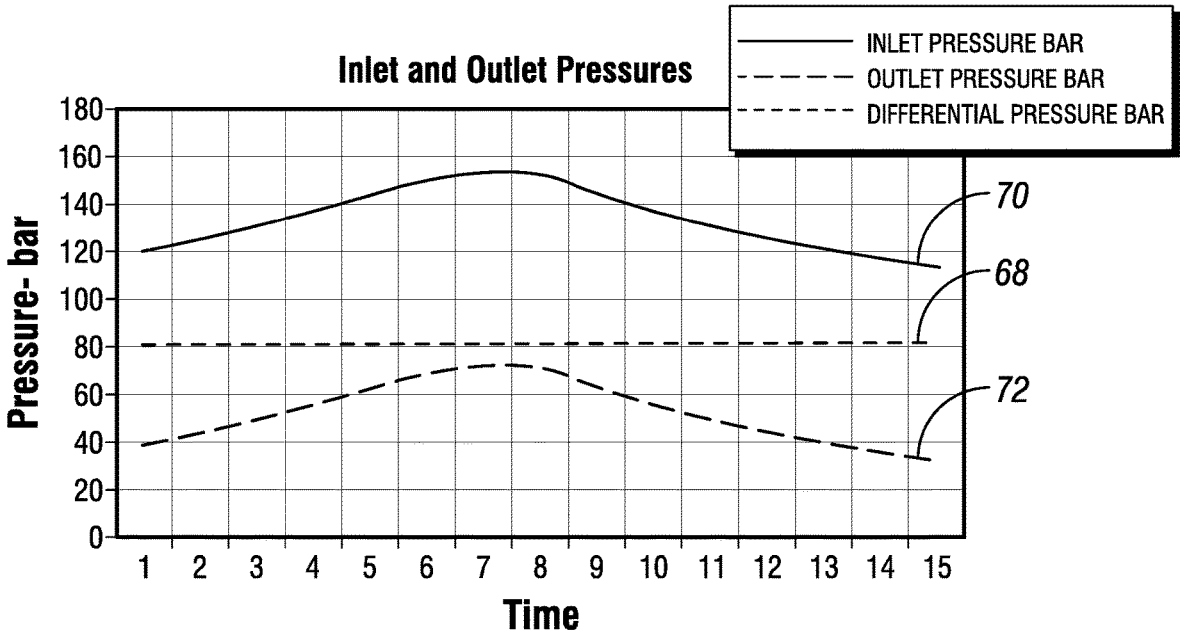
FIG. 4 provides a representative example of pressure curves associated with the valve of FIG. 2 assuming use of a larger spring.

Such hydrostatic fall-through may be addressed by increasing the spring force rating of the spring 58. This will function to increase the resistance to flow through the valve 48, such that a greater pressure differential between valve inlet 52 and outlet 54 can be accommodated before the onset of hydrostatic fall-through. A graphical example of the use of a more powerful valve spring is illustrated in FIG. 4. As in the previous graphical example of FIG. 3, the effect of the spring is such that irrespective of pressure fluctuations at the valve outlet 54, the inlet pressure 70 will always be a fixed value above the outlet pressure 72 by the differential 68. In this exemplary case a differential of around 80 bar is established by a more powerful spring, and such a spring would prevent the occurrence of hydrostatic fall-through in the specific numerical example provided above.

However, the size of a valve spring may be limited by the size of the injection valve and available space to accommodate deployment and installation of such a valve. Further, in circumstances where very large pressure differentials exist, the required size of a valve spring may be impossible to accommodate within the valve.

In addition to establishing a desired pressure differential across a valve using a spring, it is also known in the art to utilise the effect of a flow restriction within a valve to establish a desired backpressure within the injection line 40. Also, such a flow restriction may be variable to ensure a consistent injection flow rate can be achieved irrespective of the pressure differential.

As described above, in known injection valves a fixed differential between valve inlet and outlet is provided. Thus, the expectation and desire is that the valve inlet pressure will track any variations in the outlet pressure by the fixed differential. The intention of this is to prevent hydrostatic fall-through, and to facilitate a relatively constant injection rate. However, in certain circumstances, for example where the outlet pressure should drop, for example due to activation of an ESP, it has been observed that there is an unexpected sudden rush of injection fluid through the valve. This is contrary to expectation, which is that a substantially continuous injection rate should be achieved by self-adjustment of the valve to maintain the fixed pressure differential between inlet and outlet. Further, such a sudden rush of injection fluid through the valve may cause damage to the valve.

Furthermore, in the exemplary completion system shown in FIG. 1 an optional ESP 37 is provided, wherein the injection fluid is injected upstream, or on the inlet side of the ESP 37. The injection fluid may function to inhibit scale and the like within the ESP 37, to condition the production fluids to permit more efficient pumping, for example by reducing the viscosity of the production fluids, and the like. In this respect, when the ESP 37 is activated the pressure at the pump inlet, and thus at the injection location will fall. As described above, the injection valve 48 should permit this fall in pressure to be accommodated and ensure that the injection line pressure is maintained at a fixed differential above the target location pressure, and self-adjusts to ensure a consistent flow rate of injection fluid.

Figure 5:
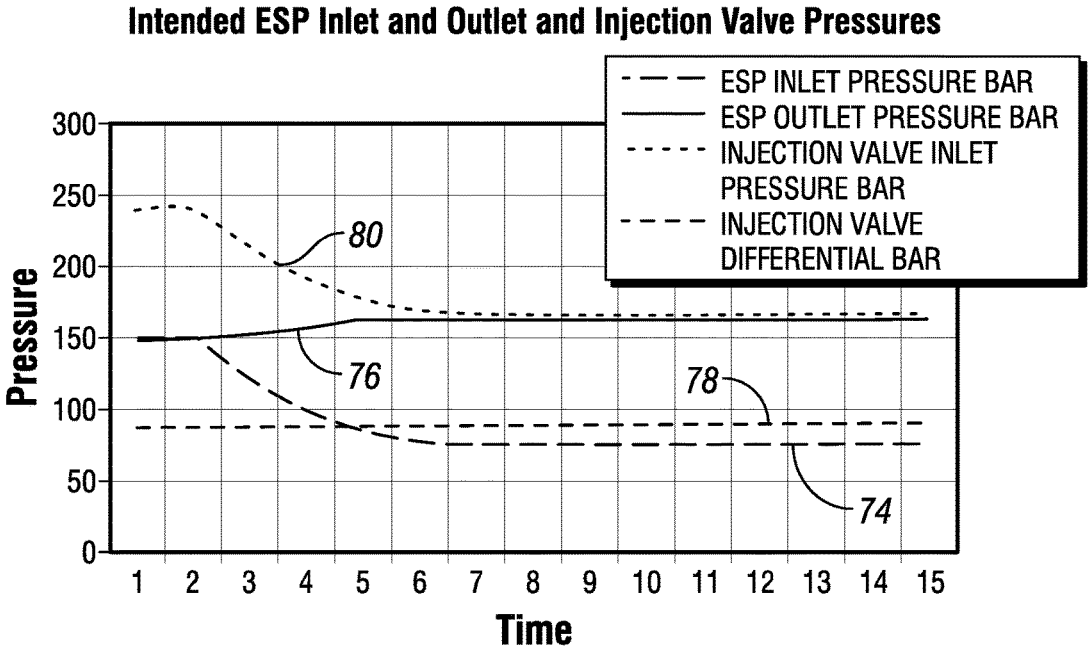
FIG. 5 provides a representative pressure plot of expected inlet and outlet pressure profiles of both in injection valve and an ESP.

Expected, and indeed desired pressure profiles at the inlet and outlet of the ESP 37, and at the inlet 52 of the valve 48 is graphically illustrated in FIG. 5. In this respect, as the ESP 37 is activated the pump inlet pressure 74 should fall, and the pump outlet pressure 76 should rise, until a steady state running condition is preferably achieved. In view of the fixed pressure differential provided by the valve 48, illustrated by line 78 in FIG. 5, the inlet pressure 80 of the valve 49 will be maintained at a fixed value above the inlet pressure 74 of the pump 37, and will thus define a substantially equivalent pressure profile, albeit at a fixed differential higher.

However, despite the expectation and desire for the pump inlet and outlet pressures to reach a steady state shortly after activation of the ESP 37, the present inventor has observed that in practice this may not be the case, and in fact the pump inlet and outlet pressures 74, 76 may not achieve the expected and desired steady state, with these pressures fluctuating for an extended period following activation of the ESP 37.

It is believed by the present inventor that such extended periods of fluctuation is caused by unsteady rates of injection via the injection valve 48 which is initiated by a sudden rush of injection fluid through the valve shortly after initial activation of the pump 37. Through diligent investigations and research by the present inventor it is considered that such a rush of fluid through the valve is caused by the compressibility of the injection fluid.

Fluids are often considered to be incompressible. This is of course not the case and along with the mechanical expansion of the tubular body of the injection line 40 any change in pressure will also lead to a change in the true compressed volume of fluid. Therefore, if the injection line 40 is at a given pressure which then is required to fall, a volume of fluid must be dissipated in order for this to occur. This volume of fluid dissipation is in addition to any fluid flow entering the injection line 40 at surface. This fluid can only be dissipated through the injection valve 48. No matter how efficient the injection valve is at maintaining a differential pressure and tracks a change in outlet pressures, the valve will have to dissipate this volume of compressed fluid to accommodate a reduction in injection line pressure.

Therefore, in order for the injection line 40 to fall in pressure the volume of fluid entrained at its starting pressure must be fully dissipated in order to reach a lower pressure. This fluid volume dissipation therefore results in a significant rise or surge of flow through the injection valve 48 as the injection line pressure falls. This may occur as the ESP 37 is brought online causing the ESP inlet pressure and therefore the injection valve 48 outlet pressure to fall. As the injection valve 48 attempts to maintain a fixed differential from its inlet 52 to outlet 54 it allows the increased flow to occur through itself.

This rise in flow may be very significant and constitute a flow surge through the injection valve 48. This has another detrimental effect where the increased fluid flow gains kinetic momentum and the injection valve 48 can be overwhelmed by this over-flow condition. Once the flow surge has passed the inlet pressure may have fallen beneath the required pressure to overcome the resistance in the valve 48 and allow forward flow. In doing this the injection line 40 must gain in pressure before it can reach a value to overcome the valve resistance pressure and continue to flow again.

Figure 6:
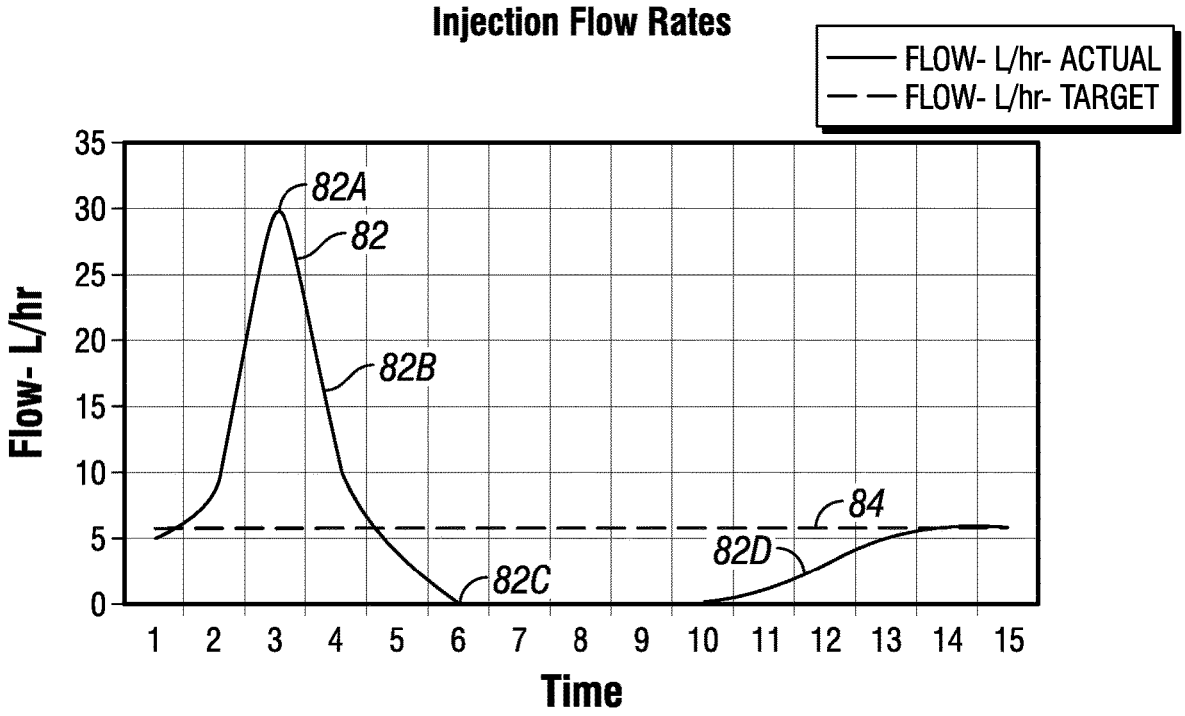

FIG. 6 provides a generalised illustration of a flow curve 82 which shows a flow spike 82*a* followed by a fall in flow 82*b*, a stop in flow 82*c* and then a slow recovery 82*d* until flow is normalised again relative to the target flow 84.

In the cases of diluent injection, the phenomena of an inconsistent flow rate downhole at the point of injection can have extremely detrimental results. A surge of diluent flow may overdose the diluent injection input resulting in a lighter fluid for the ESP 37 to pump followed by a fall in diluent flow which increases fluid weight causing a reduction in ESP pumping efficiency.

The ESP 37 is therefore seen to increase flow then suffer a reduction in efficiency, with it being observed that the ESP outlet pressure rises as its inlet falls but then suffers a reduction in efficiency where its outlet falls again as the inlet rises, while the injection valve 48 is seen to track the ESP inlet pressure. This is due firstly to the surge of diluent and then the fall in diluent flow.

Figure 7:
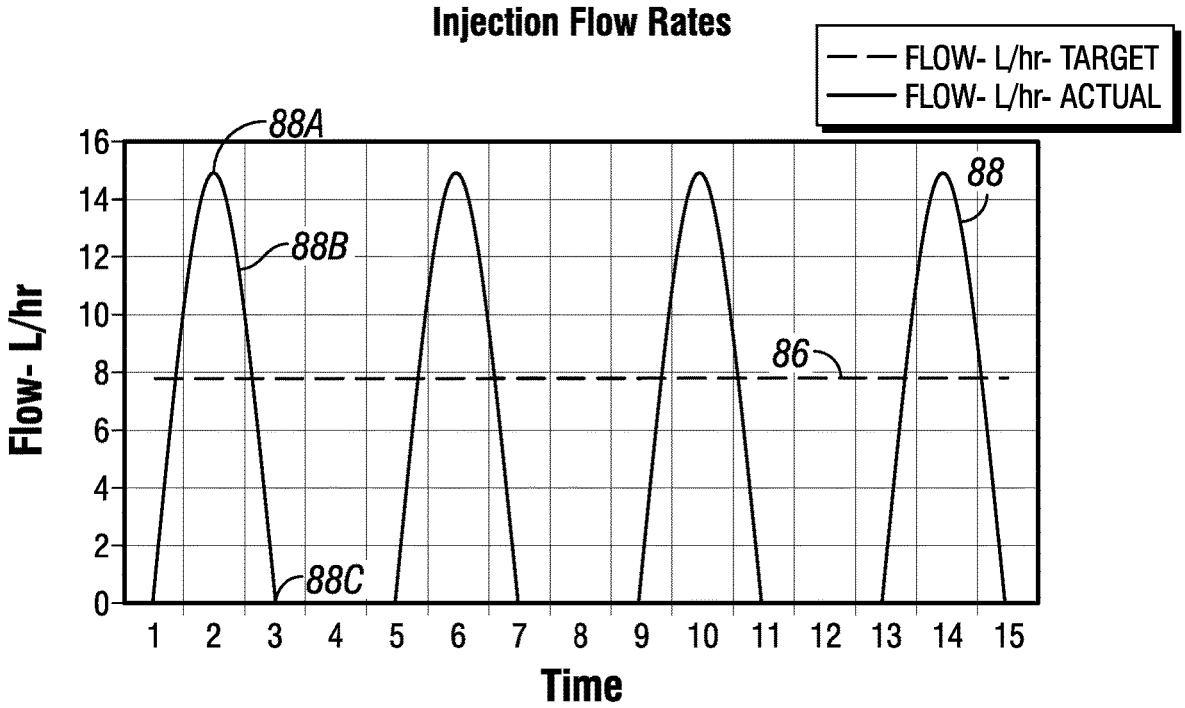
FIG. 7 provides a time variation flow rate of injection fluid through an injection valve.

It is therefore considered likely that the injection flow will resemble that illustrated in FIG. 7, where despite a constant target flow 86, the actual flow 88 will rise to a peak 88*a* followed by a fall 88*b*, and likely a complete stoppage 88*c*, in relation to a fixed flow input at surface. This will manifest as a continual cyclic behaviour never allowing full efficiency of the ESP 37.

Figure 8:
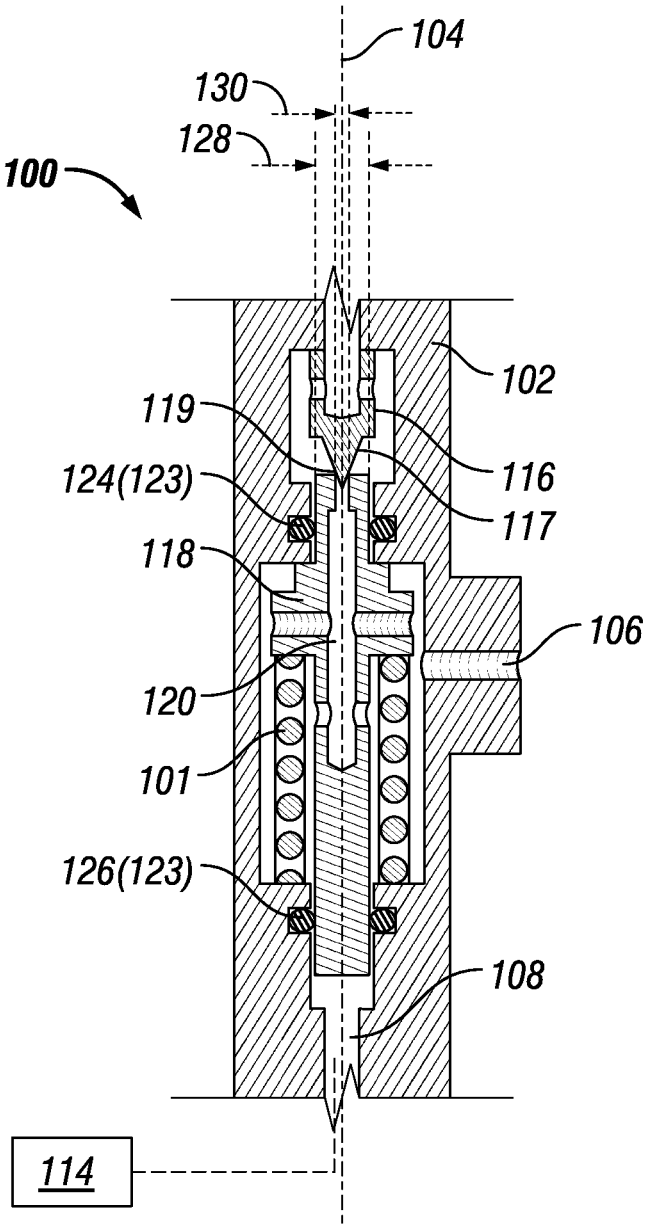
FIG. 8 (Prior Art)
FIG. 8 is a diagrammatic illustration of a prior art valve.

The present inventor has previously suggested a very robust solution to this problem, for example as disclosed in WO 2014/037584, the disclosure of which is incorporated herein by reference. Such a solution provides an injection valve which can function to maintain a fixed and constant injection line pressure regardless of reservoir pressure, and thus regardless of the operation of an ESP, for example. FIG. 8 provides a diagrammatic illustration of an exemplary embodiment of such a known injection valve, generally identified by reference numeral 100.

The injection valve 100 includes a housing 102 defining an inlet 104, outlet 106 and a reference pressure port 108. The inlet 104 is in communication with a source of injection fluid, for example via an injection line. The outlet 106 is in communication with a target location, such as a downhole location. The reference pressure port 108 is in communication with a source of reference pressure 114.

The device 100 further includes a first valve member 116 which is rigidly secured to the housing 102, and a second valve member 118 moveably mounted within the housing 102 and defining a flow path 120 extending therethrough to facilitate fluid communication between the inlet 104 and outlet 106. As will be described in further detail below, the second valve member 118 is permitted to move in accordance with inlet and reference pressures to vary flow between the inlet 104 and outlet 106.

The first valve member 116 defines a valve surface 117 and the second valve member 118 defines a valve seat 119, wherein when the valve surface 117 is engaged with the valve seat a sealed area is formed therebetween, such that when the first and second valve members 116, 118 are engaged flow through the flow path 120 is prevented. However, when the second valve member 118 is moved the valve members 116, 118 become disengaged such that flow is permitted. Also, when the first and second valve members 116, 118 are disengaged the gap defined therebetween may create a flow restriction and movement of the second valve member 118 may vary this flow restriction to assist to vary flow of injection fluid through the device 100.

The device 100 further comprises a biasing spring 101 which acts on the second valve member 118 to bias this in an upward direction (relative to the orientation of FIG. 8), towards engagement with the first valve member 116.

The device 100 further comprises a sealing arrangement 123 which includes first and second sealing assemblies 124, 126 extending between the second valve member 116 and the housing 102. The first sealing assembly 124 provides isolation between the inlet 104 and the outlet 106, such that flow between the inlet and outlet must be achieved via the flow path 120 in the second valve member 118. Further, the second sealing assembly 126 isolates the outlet 106 from the reference pressure port 108.

The first sealing assembly 124 is exposed to inlet fluid pressure, such that said inlet fluid pressure will establish a force on the second valve member 118 in a downward direction (relative to the orientation of FIG. 8). Further, the second sealing assembly 126 is exposed to reference pressure such that said reference pressure will establish a force on the second valve member 118 in an upward direction (again, relative to the orientation of FIG. 8). Accordingly, a net force will be applied on the second valve member 118 by the action of the inlet and reference pressures, and in particular in accordance with a pressure differential between the inlet and outlet pressures.

Both the first and second sealing assemblies 124, 126 are exposed to outlet fluid pressure, such that the effect of this outlet pressure will be cancelled (due to the equivalent seal size). Accordingly, the outlet pressure, which will largely be defined by pressure at the target location, will not have any effect on the operation of the device 100. This assists to avoid problems identified above which stem from possible variations in outlet pressure resulting in a sudden surge through an injection device.

In use, for flow through the device 100 to be established, the force applied on the second valve member 118 by the inlet pressure must exceed the combined force applied by the reference pressure and the spring 101. In this way, the inlet pressure may be presented at a pressure which is greater than the reference pressure by the appropriate equivalent pressure generated by the spring 101, in addition to any backpressure created by the restriction to flow between the first and second valve members 116, 118.

Although the example valve 100 illustrated in FIG. 8 is very effective, in some applications this may limit the permitted flow rate. That is, in order for the valve 100 to function, the sealed diameter or area 128 of the second valve member 118 must be greater than the diameter or area 130 of the sealed area between the valve surface 117 and valve seat 119 when engaged. If this area is not greater then the pressure applied to the second valve member diameter or area 128 will not be sufficient to separate the first and second valve members 116, 118. Also, any difference in the ratio of areas 128, 130 will create a hysteresis of operation from the closed to opening and regulating positions. This hysteresis is not desirable for accurate function and pressure regulation. In order to reduce this hysteresis it is therefore desirable to make the diameter 128 greatly larger than the diameter 130.

However, should this form of injection valve 100 be required for very high flows, diameter or area 130 must be significantly increased in order to accommodate such increased rates of flow. However, the second valve member 118 must also therefore be significantly increased in diameter to ensure that the diameter or area 128 of the second valve member 118 is significantly greater than the diameter or area 130 of the sealed area 122.

In increasing the diameter of the second valve member 118 to reduce any hysteresis this may thus have restrictions in the possible housing size required in order to accommodate the increase in diameter. Another consequence of this increase in diameter of the second valve member 118 is that if the absolute device opening pressure is provided by the illustrated spring 101 (often referred to as a power spring), this must increase in force accordingly. Such high force springs introduce problems such as increased deflection leading to friction and also have limitations on size also meaning a further increase in housing diameter, which may not be conducive to restricted downhole environments. As such, known devices may not be particularly suitable for downhole ultra-high flow rate fluid injection.

Figure 9A:
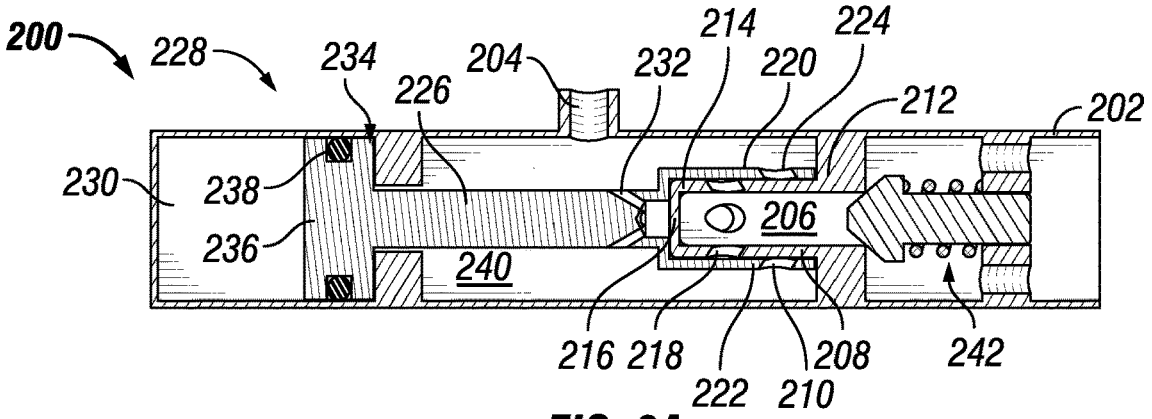
FIGS. 9A to 13 provide various embodiments of an injection valve in accordance with the present disclosure.
Figure 9B:
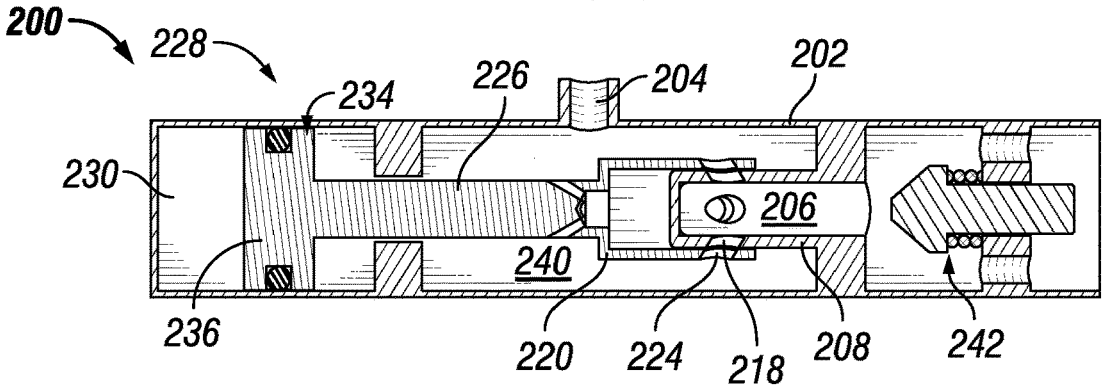

An injection device, or valve, in accordance with an embodiment of the present disclosure is shown in FIGS. 9A and 9B, with the valve shown closed in FIG. 9A, and open in FIG. 9B. The valve, generally identified by reference numeral 200, includes a housing 202 which defines a fluid inlet 204 for connecting to a source of injection fluid, such as source 42 in FIG. 1, and a fluid outlet 206 for connecting to a target location, such as injection mandrel 44 of FIG. 1.

A static outlet sleeve 208 is mounted within the housing and includes a cylindrical wall 210 which is secured at one end 212 to the housing 202, and is closed at an opposite end 214 by a cap 216. A plurality of circumferentially arranged radially extending ports 218 extend through the wall section 210, and as will be described below facilitate flow through the valve 200 from inlet 204 to outlet 206.

A moveable flow sleeve 220 is mounted within the housing 202 on an upstream (inlet) side. The flow sleeve 220 includes a cylindrical wall 222 which is of a larger diameter than that of the outlet sleeve 208, and is arranged to be received over said outlet sleeve 208. The flow sleeve 220 includes a corresponding number of radially extending ports 224 extending through the wall 222. As will be described in more detail below, movement of the flow sleeve 220 permits the ports 218, 224 of the outlet and flow sleeves to be selectively aligned and misaligned, thus controlling flow through the valve 200.

The flow sleeve 220 is connected via an engagement arrangement, in the form of a connecting rod 226, to a flow sleeve actuator 228. As will be described in more detail below, the flow sleeve actuator 228 is operated by the effect of inlet fluid pressure at the inlet 204 and biasing pressure of a compressed gas within a pressure chamber 230 to move axially, and thus adjust the relative axial position of the outlet sleeve 208 and flow sleeve 220 to control flow through the valve 200. Venting ports 232 are provided within the connecting rod 226 to minimise the risk of hydraulic locking during relative movement of the outlet sleeve 208 and flow sleeve 220.

The flow sleeve actuator 228 comprises a pressure interface arrangement 234 which includes an interface member in the form of a piston 236 mounted in the housing 202. An O-ring 238 provides a seal between the piston 236 and the housing 202 to isolate the compressed gas within the pressure chamber 230 from fluid which has entered the housing 202, into an inlet chamber 240, via the inlet 204. In such an arrangement the compressed gas in the pressure chamber 230 may act over the area of the piston 236 to urge said piston to the right (relative to the illustration). In such a case the compressed gas functions to bias the piston 236 to the right (which is a closing direction of the valve 200). Inlet fluid pressure within the inlet chamber 240 may act over the area of the piston 236 to urge said piston to the left (relative to the illustration), against the bias of the compressed gas. Accordingly, variations in differential pressure between the compressed gas and the inlet fluid may result in movement of the piston 236, with corresponding movement of the flow sleeve 220 via the connecting rod 226.

A check valve 242 is positioned to operate at the outlet 206 of the housing to function as a non-return valve, to prevent reverse flow through the valve 200.

In use, the valve 200 may be initially configured as shown in FIG. 9A, with the flow sleeve 220 fully received over the outlet sleeve 208 with the respective radial ports 218, 224 fully misaligned to restrict flow through the device. In such a configuration the flow sleeve 220 may be considered to be in a first position. In some cases a very small leak path may be present between the outlet and flow sleeves 208, 220, and in many applications this is tolerable, such as in diluent injection where leakage rates may be negligible compared to actual injection rates.

As fluid pressure applied at the inlet 204 is increased, an increasing force will be applied on the piston 236, until the inlet fluid pressure exceeds the gas pressure within the pressure chamber 230, or more accurately until the force exerted by the inlet fluid pressure exceeds the force exerted by the gas pressure, accounting for the possibility that variable piston areas may be provided. At this time the piston 236 will move to provide corresponding movement of the flow sleeve 220 via the connecting rod 226, as illustrated in FIG. 9B. The valve 200 is illustrated in FIG. 9B in a fully open position, with the respective ports 218, 224 fully aligned. In this arrangement the flow sleeve 220 may be considered to be in a second position.

During initial or increased flow through the radial flow ports 218, 224, inlet pressure will reduce, causing automatic adjustment of the flow sleeve actuator 228 and thus the flow sleeve 220, to restrict or choke flow. Such choked flow will result in a back pressure being applied at the inlet 204, thus again increasing inlet pressure, with the flow sleeve actuator 228 being automatically adjusted. Such adjustment will continuously and autonomously be made, effectively achieving a forward flow equilibrium position with the inlet pressure being maintained at a fixed and absolute pressure. The equilibrium inlet pressure may thus be a function of the biasing force of the gas within the pressure chamber 230, and be largely or entirely independent of fluid pressure at the outlet 206 or target location. Such an arrangement may provide significant advantages in addressing issues with u-tubing or hydrostatic fall-through in injection lines associated with the injection device 200.

Further, because a radial flow path is achieved by the radial flow ports 218, 224 any pressures that occur in the region of said ports will act largely radially, and not axially. Thus, any pressures that occur as fluid is passed through the flow ports 218, 224 as well as any pressures acting on the device outlet 206 shall not create forces that will act on, or resit, the flow sleeve actuator 228, which will thus be permitted to be operated largely on the basis of inlet pressure and pressure within the pressure chamber 230. This arrangement can permit the valve 200 to allow a greatly variable flow performance at a uniform inlet pressure and tolerate wide variations in the outlet pressure presented to the device outlet 206.

From this, embodiments of the present disclosure may allow for a very large controllable flow area to be presented to allow communication of flow form the inlet 204 to the outlet 206 without this presented flow area having any direct influence on the effective area of the flow sleeve actuator 228. This may assist to address a limitation of the prior art in that there is no need to increase the effective area of the flow sleeve actuator 228 to a significant value above that of the flow area that is provided by the valve. This therefore means a very compact valve may be provided which will provide a wide variation of flow rates with capability of extremely high flow without having to employ a large flow sleeve actuator 228 and therefore large housing 202 for said actuator 228.

In the valve 200 the pressure chamber 230 is provided as a closed chamber. However, in other embodiments this may comprise a port for pressure communication with an external pressure source. Further, in addition to, or in substitution for, a spring biasing arrangement may be provided. Further, the connecting rod 226 of the valve 200 provides a rigid connection between the flow sleeve actuator 228 and the flow sleeve 220. However, in other embodiments a lost motion type connection may be provided.

Figure 10A:
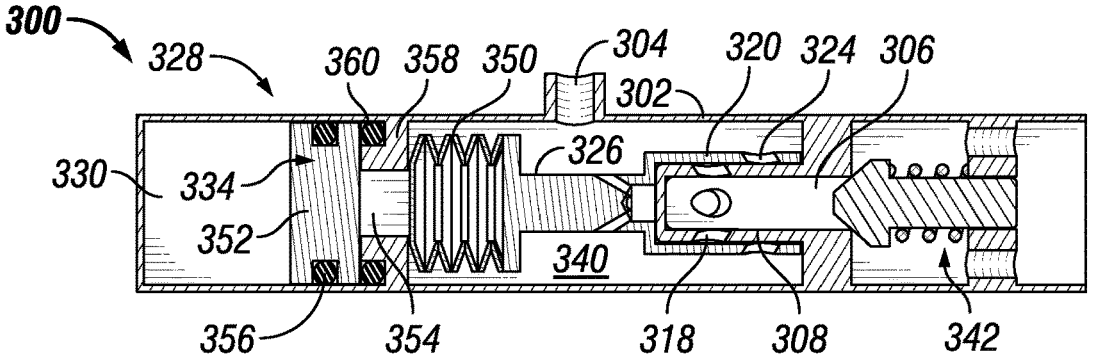
Figure 10B:
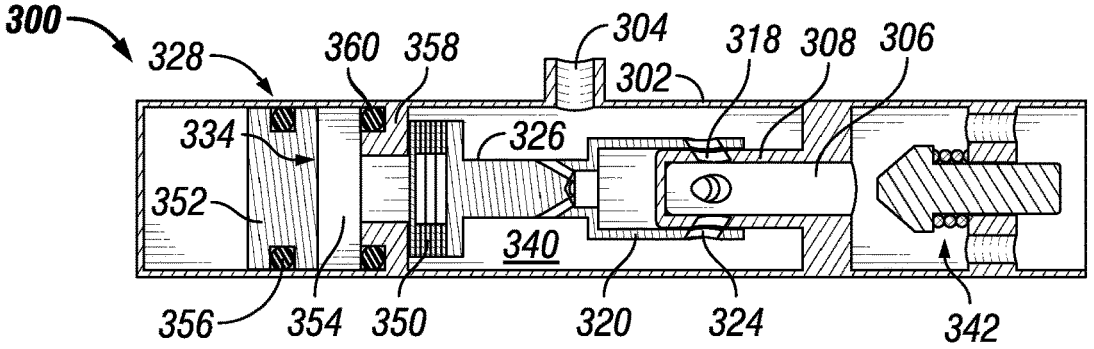

An alternative embodiment of an injection valve, generally identified by reference numeral 300 is illustrated in FIGS. 10A and 10B, with the valve 300 shown in a fully closed position in FIG. 10A, and a fully open position in FIG. 10B. The valve 300 is largely similar to the valve 200 first shown in FIG. 9A, and as such like features share like reference numerals, incremented by 100. Accordingly, the valve 300 includes a housing 302 including an inlet 304 and an outlet 306, with a check valve 342 operating at the outlet 306. An outlet sleeve 308 with radial flow ports 318 is mounted within the housing 302, and a moveable flow sleeve 320 with radial flow ports 324 extends over the outlet sleeve 308. The flow sleeve 320 is connected, via a connecting rod 326, to a flow sleeve actuator 328. The flow sleeve actuator 328 is operated by opposing force achieved by inlet pressure within an inlet chamber 340 and gas pressure within a pressure chamber 330. Variations in pressure differential across the flow sleeve actuator 328 causes the actuator to move the flow sleeve 320 relative to the outlet sleeve 308, controlling flow through the valve 300.

In the present embodiment the flow sleeve actuator 328 includes a pressure interface arrangement 334 having a first interface member 350 in the form of a bellows arrangement, and a second interface member 352 in the form of a floating piston. The connecting rod 326 is secured to the bellows arrangement 350. The bellows arrangement 350 is in pressure communication with inlet fluid pressure, whereas the floating piston 352 is in pressure communication with the pressure chamber 330.

An intermediate chamber 354 which is filled with a fluid, such as silicon oil, is defined between the bellows arrangement 350 and the floating piston 352. The bellows arrangement 350 provides fluid isolation between the inlet chamber 340 and the intermediate chamber 354. An O-ring 356 associated with the floating piston 352 provides fluid isolation between the pressure chamber 330 and the intermediate chamber 354. In use, with the valve 300 within the fully closed position as in FIG. 10A, pressure within the inlet chamber 340 will establish an equal pressure within the intermediate chamber 354 via the bellows arrangement 350. Increasing inlet pressure will thus provide increasing pressure within the intermediate chamber 354 until the pressure within the pressure chamber 330 may be exceeded, resulting in movement of the floating piston 352, and compression or collapse of the bellows arrangement 350, with resulting movement of the flow sleeve 320 to the open position, as shown in FIG. 10B.

When the valve 300 is closed, as illustrated in FIG. 10A, with reduced or minimal applied inlet pressure, the floating piston 352 is bottomed-out on an annular lip 358. This arrangement effectively decouples or isolates the pressure within the pressure chamber 330 from the intermediate chamber 354, and thus from the bellows arrangement 350. In this way, the bellows arrangement 350 may be protected from overpressure and potential damage. This may particularly be the case when the pressure chamber 330 is fully charged with pressure (for example compressed nitrogen gas), wherein the inlet chamber is at atmospheric pressure.

A further O-ring seal 360 is provided between the annular lip 358 and the floating piston 352 when engaged. The O-ring 360 is illustrated as mounted on the annular lip 358, but in alternative embodiments could be provided on the floating piston 352. The provision of this O-ring seal 360 may provide additional sealing contingency when the floating piston 352 is bottomed-out on the annular lip 358.

A similar effect may be achieved by the bellows arrangement 350 in that the bellows arrangement when fully collapsed, as shown in FIG. 10B may become supported by the annular lip 358, thus isolating the intermediate chamber from the inlet pressure.

Figure 11A:
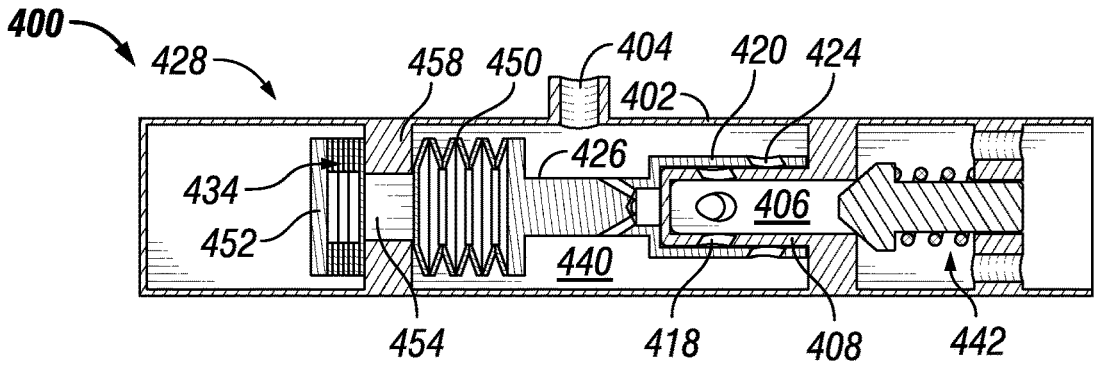
Figure 11B:
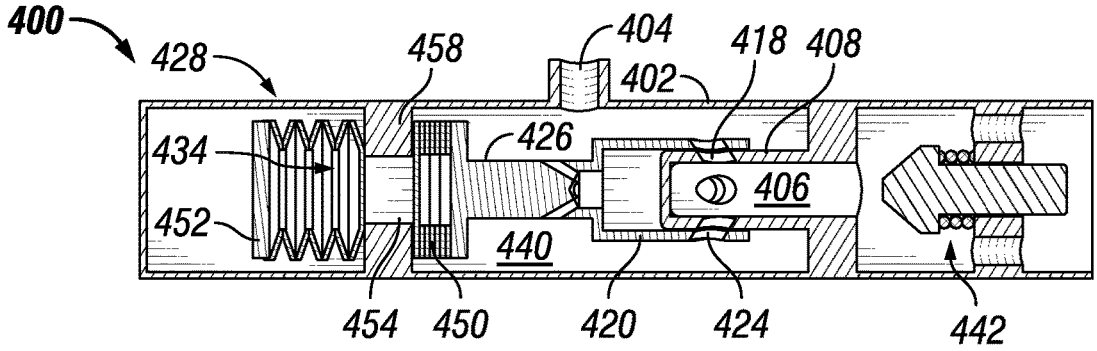

A further alternative embodiment of an injection valve, generally identified by reference numeral 400, is shown in FIGS. 11A and 11B, with the valve 400 shown in a fully closed position in FIG. 11A, and a fully open position in FIG. 11B. The valve 400 is largely similar to the valve 300 first shown in FIG. 10A, and as such like features share like reference numerals, incremented by 100. Accordingly, the valve 400 includes a housing 402 including an inlet 404 and an outlet 406, with a check valve 442 operating at the outlet 406. An outlet sleeve 408 with radial flow ports 418 is mounted within the housing 402, and a moveable flow sleeve 420 with radial flow ports 424 extends over the outlet sleeve 408. The flow sleeve 420 is connected, via a connecting rod 426, to a flow sleeve actuator 428. The flow sleeve actuator 428 is operated by opposing forces achieved by inlet pressure within an inlet chamber 440 and gas pressure within a pressure chamber 430. Variations in pressure differential across the flow sleeve actuator 428 causes the actuator to move the flow sleeve 420 relative to the outlet sleeve 408, controlling flow through the valve 400.

In the present embodiment the flow sleeve actuator 428 includes a pressure interface arrangement 434 having a first bellows arrangement 450 and a second bellows arrangement 452, with the connecting rod 426 secured to the first bellows arrangement 450. The first bellows arrangement 450 is in pressure communication with inlet fluid pressure, whereas the second bellows arrangement 452 is in pressure communication with the pressure chamber 430.

An intermediate chamber 454 which is filled with a fluid, such as silicon oil, is defined between the bellows arrangements 450, 452. In use, with the valve 400 within the fully closed position as in FIG. 11A, pressure within the inlet chamber 440 will establish an equal pressure within the intermediate chamber 454 via the first bellows arrangement 450. Increasing inlet pressure will thus provide increasing pressure within the intermediate chamber 454 until the pressure within the pressure chamber 430 may be exceeded, resulting in expansion of the second bellows arrangement 452, and compression or collapse of the first bellows arrangement 450, with resulting movement of the flow sleeve 420 to the open position, as shown in FIG. 11B.

The provision of respective bellows arrangements 450, 452 eliminates the requirement to utilise additional seals, such as O-rings, and may provide a relatively reduced friction assembly.

In use, and in a similar manner to the operation of the valve 300 in FIGS. 10A and 10B, the bellows arrangements 450, 452 may be permitted to collapse against an annular lip 458, to minimise the risk of any overpressure being applied within he intermediate chamber 454.

Figure 12A:
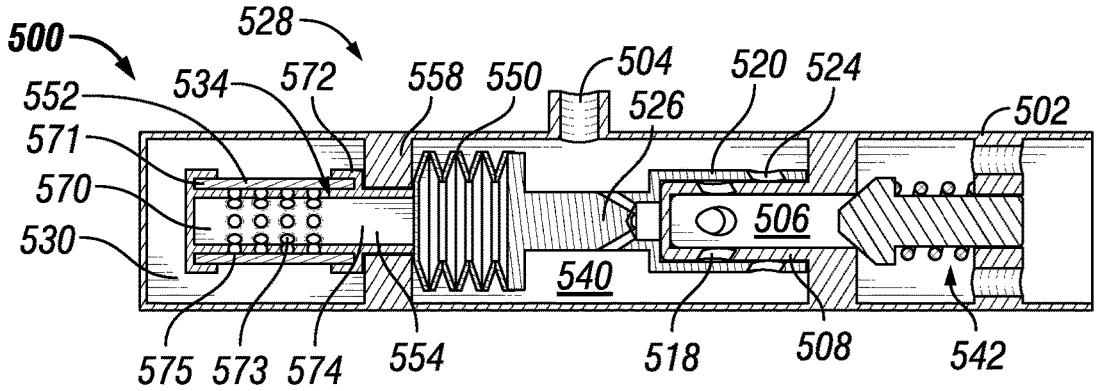
Figure 12B:
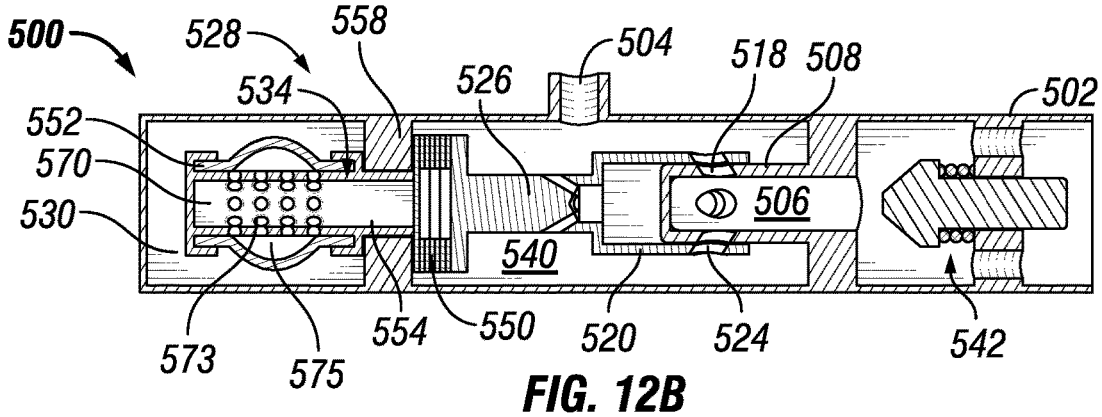

A further alternative embodiment of an injection valve, generally identified by reference numeral 500, is shown in FIGS. 12A and 12B, with the valve 500 shown in a fully closed position in FIG. 12A, and a fully open position in FIG. 12B. The valve 500 is largely similar to the valve 400 first shown in FIG. 11A, and as such like features share like reference numerals, incremented by 100. Accordingly, the valve 500 includes a housing 502 including an inlet 504 and an outlet 506, with a check valve 542 operating at the outlet 506. An outlet sleeve 508 with radial flow ports 518 is mounted within the housing 502, and a moveable flow sleeve 520 with radial flow ports 524 extends over the outlet sleeve 508. The flow sleeve 520 is connected, via a connecting rod 526, to a flow sleeve actuator 528. The flow sleeve actuator 528 is operated by opposing forces achieved by inlet pressure within an inlet chamber 540 and gas pressure within a pressure chamber 530. Variations in pressure differential across the flow sleeve actuator 528 causes the actuator to move the flow sleeve 520 relative to the outlet sleeve 508, controlling flow through the valve 500.

In the present embodiment the flow sleeve actuator 528 includes a pressure interface arrangement 534 having a bellows arrangement 550 in pressure communication with inlet fluid pressure, and an inflatable bladder 552 in pressure communication with the pressure chamber 530. The inflatable bladder 552 is mounted on a tubular member 570, and sealed thereto at opposing axial ends 571, 572. The tubular member 570 defines a plurality of ports 573 providing fluid communication between an internal volume 574 of the tubular member 570, and an internal volume 575 of the inflatable bladder 552. The tubular member 570 may be sintered.

An intermediate chamber 554 which is filled with a fluid, such as silicon oil, is defined between the bellows arrangements 550 and the inflatable bladder 552. In use, with the valve 500 within the fully closed position as in FIG. 12A, pressure within the inlet chamber 540 will establish an equal pressure within the intermediate chamber 554 via the bellows arrangement 550. Increasing inlet pressure will thus provide increasing pressure within the intermediate chamber 554 until the pressure within the pressure chamber 530 may be exceeded, resulting in inflation of the inflatable bladder 552, and compression or collapse of the bellows arrangement 550, with resulting movement of the flow sleeve 520 to the open position, as shown in FIG. 12B.

In use, the bellows arrangement 550 may be permitted to collapse against an annular lip 558, to minimise the risk of any overpressure being applied within he intermediate chamber 554. Furthermore, deflation of the inflatable bladder 552 against the tubular member 570 may provide a corresponding effect.

During inflation and deflation of the bladder 552 the fluid in the intermediate chamber 554 will pass through the ports or pores 573 in the tubular member 570 to provide a dampening effect. This may be used to reduce potential oscillations should there be any risk of drastically changing pressures on the outlet 506 which may cause fluctuations in axial movement of the moveable flow sleeve 520.

Figure 13A:
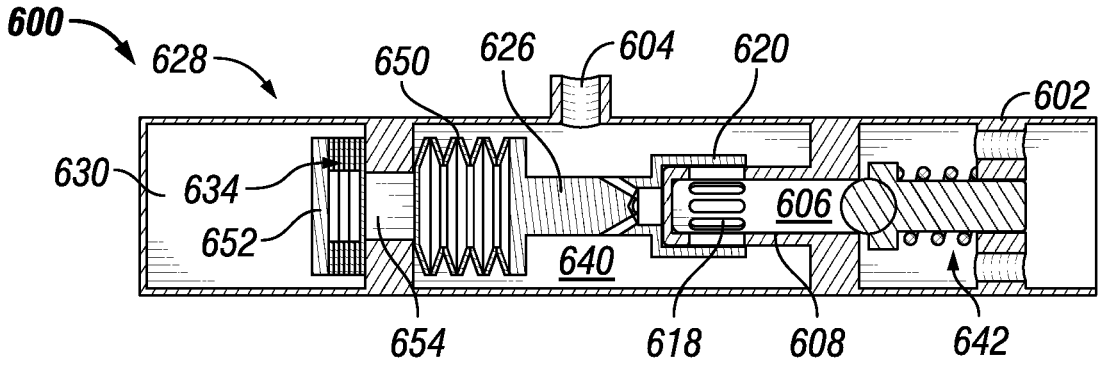
Figure 13B:
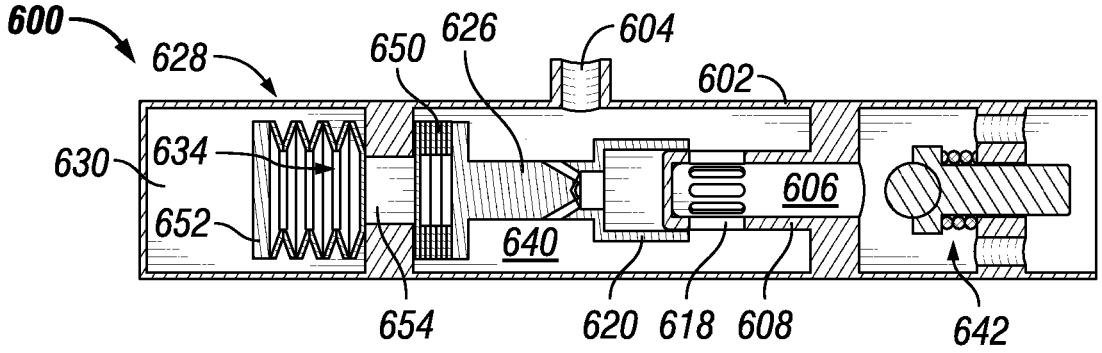

A further alternative embodiment of an injection valve, generally identified by reference numeral 600, is shown in FIGS. 13A and 13B, with the valve 600 shown in a fully closed position in FIG. 13A, and a fully open position in FIG. 13B. The valve 600 is largely similar to the valve 400 first shown in FIG. 11A, and as such like features share like reference numerals, incremented by 200. For brevity of the present description only the differences between valves 400 and 600 will be highlighted. In this respect, valve 600 includes an outlet sleeve 608 which includes a plurality of circumferentially arranged radial ports 618 which are elongate in an axial direction. A flow sleeve 620, unlike in other embodiments, does not include flow ports, and instead has a continuous cylindrical wall structure. In such an arrangement, axial movement of the flow sleeve 620 causes an end of said flow sleeve 620 to gradually uncover and cover the flow ports 618 in the outlet sleeve 608.

Figure 14:
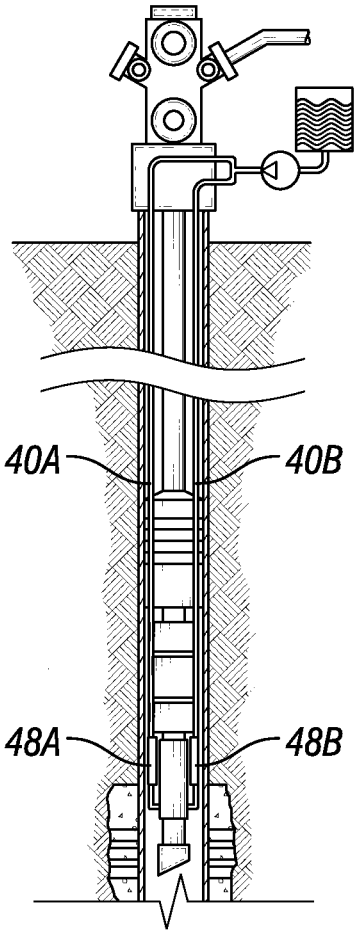
FIGS. 14 and 15 provide alternative wellbore completion installations in which embodiments of injection valve according to the present disclosure may be utilised.

Embodiments of injection valves of the present disclosure may be used to substitute valve 48 illustrated in FIG. 1, such that the present disclosure may be used in combination with a completion system including an injection line 40. However, in other exemplary uses, embodiments of injection valves according to the present disclosure may be utilised within a completion system such as illustrated in FIG. 14. In such a system multiple valves 48*a*, 48*b* (which may be provided in accordance with the present disclosure) may be connected to respective injection lines 40*a*, 40*b*. Such an arrangement may facilitate high injection flow rates. The features of the system in FIG. 14 are otherwise largely similar to that shown in FIG. 1 and as such no further description will be provided.

Figure 15:
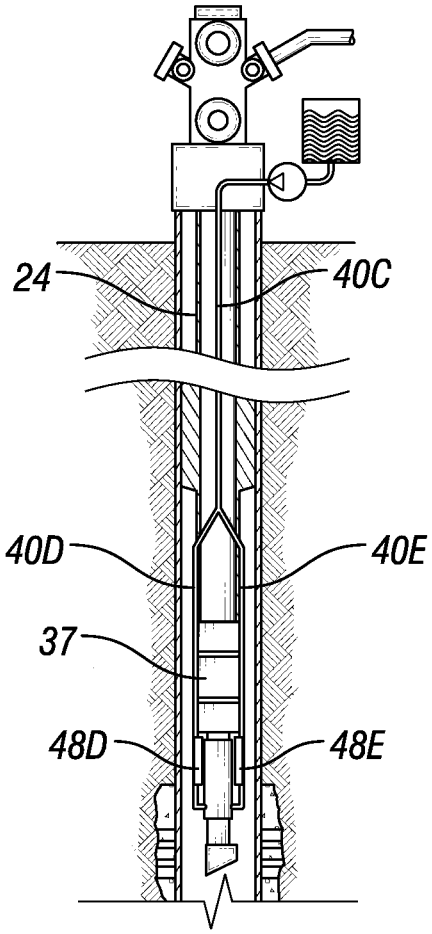

In an alternative arrangement, shown in FIG. 15, injection fluid may be conveyed using a larger upper tubing 40*c* that may be provided within the production tubing 24 (often referred to as "slim tubing"), which is then diverted around the ESP 37 into individual lines 40*d*, 40*e*, to feed respective injection valves 40*d*, 40*e*.

In the various embodiments described above a flow sleeve actuator (e.g., actuator 228 in FIG. 9A) provides movement control of a flow sleeve relative to an outlet sleeve. However, the features of the various embodiments of flow sleeve actuator (which include a pressure interface arrangement) may be utilised to provide control of any actuatable member, and are not restricted for use only with a flow sleeve. In FIGS. 9 to 12 four different exemplary forms of actuator (228, 328, 428 and 528) are presented. Each of these may be used independently of a flow sleeve/outlet sleeve arrangement. This is illustrated in the embodiments in FIGS. 16 to 19, which in each case provide a valve pin 70 as an actuatable member, which is moved to cooperate with a valve seat 72 to control flow between an inlet 74 and an outlet 76.

Figure 16A:
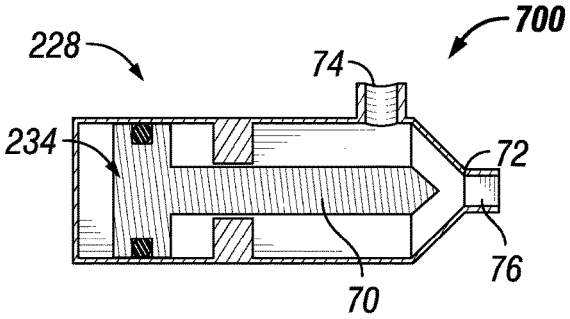
FIGS. 16A to 19B provide various embodiments of an actuator according to the present disclosure.
Figure 16B:
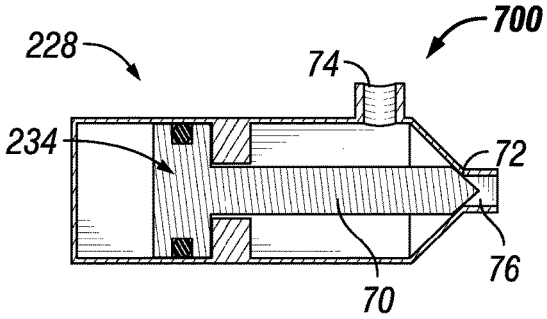

FIG. 16A provides an actuator arrangement, generally identified by reference numeral 700, which includes an actuator arrangement which is equivalent to arrangement 228 which includes a pressure interface arrangement 234 first shown in FIG. 9A. FIG. 16A illustrates the valve pin 70 in an open position, and FIG. 16B illustrates the valve pin 70 in a closed position. The form and operation of the actuator arrangement 228 is similar to that of FIG. 9A, and as such no further description will be given.

Figure 17A:
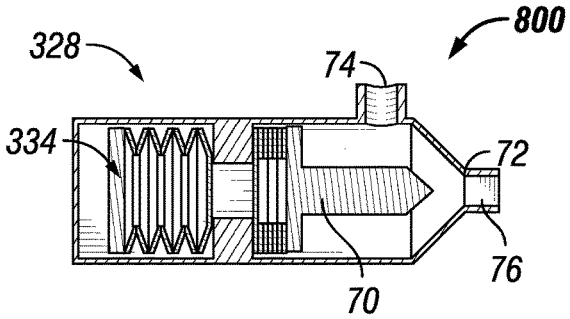
Figure 17B:
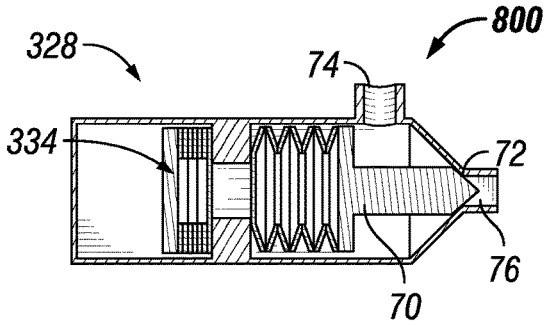

FIG. 17A provides an actuator arrangement, generally identified by reference numeral 800, which includes an actuator arrangement which is equivalent to arrangement 328 which includes a pressure interface arrangement 334 first shown in FIG. 10A. FIG. 17A illustrates the valve pin 70 in an open position, and FIG. 17B illustrates the valve pin 70 in a closed position. The form and operation of the actuator arrangement 328 is similar to that of FIG. 10A, and as such no further description will be given.

Figure 18A:
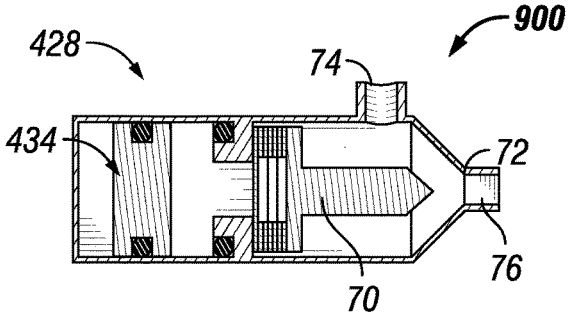
Figure 18B:
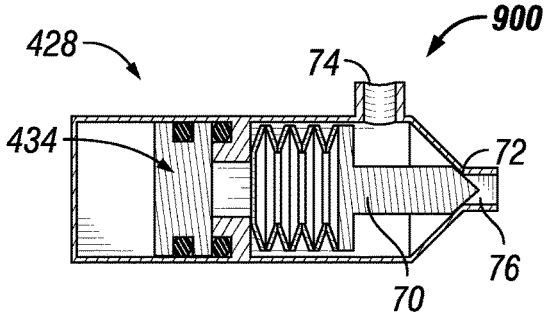

FIG. 18A provides an actuator arrangement, generally identified by reference numeral 900, which includes an actuator arrangement which is equivalent to arrangement 428 which includes a pressure interface arrangement 434 first shown in FIG. 11A. FIG. 18A illustrates the valve pin 70 in an open position, and FIG. 18B illustrates the valve pin 70 in a closed position. The form and operation of the actuator arrangement 428 is similar to that of FIG. 11A, and as such no further description will be given.

Figure 19A:
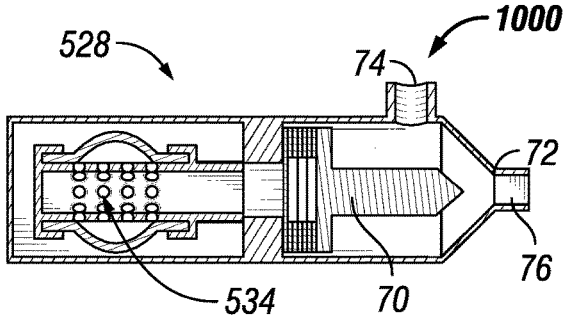
Figure 19B:
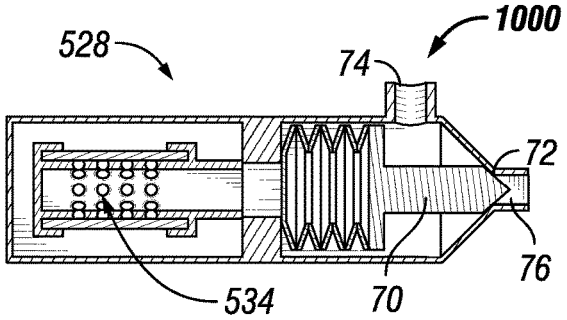

FIG. 19A provides an actuator arrangement, generally identified by reference numeral 1000, which includes an actuator arrangement which is equivalent to arrangement 528 which includes a pressure interface arrangement 534 first shown in FIG. 12A. FIG. 19A illustrates the valve pin 70 in an open position, and FIG. 19B illustrates the valve pin 70 in a closed position. The form and operation of the actuator arrangement 528 is similar to that of FIG. 12A, and as such no further description will be given.

It should be understood that the embodiments described herein are merely exemplary and that various modifications may be made thereto without departing from the scope of the present disclosure.

The invention claimed is:

1. An injection device, comprising:

a housing comprising an inlet and an outlet;

an outlet sleeve mounted within the housing and comprising at least one radial flow port therethrough for permitting fluid communication between the inlet and the outlet;

a flow sleeve mounted over the outlet sleeve and arranged to move between a first position in which the at least one radial flow port is at least partially closed and a second position in which the at least one radial flow port is opened;

a flow sleeve actuator operable by a biasing arrangement biasing the flow sleeve to the first position and inlet pressure at the inlet of the housing to permit the flow sleeve to be selectively moved between the first and second positions to vary flow through the at least one radial flow port between the inlet and the outlet; and wherein the biasing arrangement operates to permit the flow sleeve to move towards the first position in which the at least one radial flow port is at least partially closed such that the injection device is normally closed, and an increase in inlet pressure acts to operate the actuator to permit the flow sleeve to move towards the second position.

2. The injection device of claim 1, wherein the outlet sleeve is fixed within the housing and comprises a static outlet sleeve.

3. The injection device of claim 1, wherein the flow sleeve is mounted on the upstream side of the outlet sleeve.

4. The injection device of claim 1, wherein at least one radial flow port comprises an elongate slot that is elongate in an axial direction relative to the outlet sleeve.

5. The injection device of claim 1, wherein the housing comprises an inlet chamber for receiving fluid through the inlet, at least a portion of the outlet sleeve extending into the inlet chamber and providing fluid communication, via the at least one radial flow port, between the inlet chamber and the outlet of the housing.

6. The injection device of claim 5, wherein the flow sleeve is configured to operate within the inlet chamber.

7. The injection device of claim 1, comprising a pressure chamber in pressure communication with the flow sleeve actuator, wherein the pressure chamber is configured to contain a resistance pressure for use in providing a biasing force on the flow sleeve actuator.

8. The injection device of claim 7, wherein the flow sleeve actuator comprises a pressure interface arrangement in opposing pressure communication with the housing inlet and the pressure chamber, such that, in use, the pressure interface arrangement may be moved by the effect of both inlet pressure and pressure within the pressure chamber.

9. The injection device of claim 8, wherein the pressure interface arrangement is operably connected to the flow sleeve.

10. The injection device of claim 8, wherein the pressure interface arrangement comprises an interface member in pressure communication with both the housing inlet and the pressure chamber.

11. The injection device of claim 10, wherein the interface member is sealed relative to the housing via a seal member.

12. The injection device of claim 10, wherein the pressure interface arrangement comprises first and second interface members with an intermediate chamber defined therebetween, wherein the first interface member is in pressure communication with the housing inlet, and the second interface member is in pressure communication with the pressure chamber.

13. The injection device of claim 12, wherein the intermediate chamber defines a transfer chamber and comprises a pressure transfer medium for transferring the effect of pressure acting on the respective first and second interface members.

14. The injection device of claim 12, wherein the intermediate chamber is sealingly isolated from both the housing inlet and the pressure chamber via a sealing arrangement.

15. The injection device of claim 12, wherein at least one of the first and second interface members comprises a piston member.

16. The injection device of claim 12, wherein at least one of the first and second interface members comprises a bellows arrangement.

17. The injection device of claim 12, wherein at least one of the first and second interface members comprises an inflatable structure.

18. The injection device of claim 17, wherein the inflatable structure is mounted on a tubular member, which tubular member comprises one or more ports to facilitate fluid transfer between an internal volume of the tubular member and the inflatable structure.

19. A method for injecting a fluid from a source to a target location, comprising:

coupling a fluid source to an inlet of an injection device;

coupling an outlet of the injection device to a target region; and using inlet pressure in combination with a biasing force to control movement of a flow sleeve actuator of the injection device to control relative movement between an outlet sleeve and a flow sleeve contained within the injection device, wherein:

said biasing force biases the flow sleeve into a first position closing a radial port in the outlet sleeve to the inlet, and wherein;

said relative movement varies exposure of said radial port to the inlet; and an increase in the inlet pressure acts to operate the flow sleeve actuator to permit the flow sleeve to move towards a second position in which the radial flow port is opened.

* * * * *